US006675902B2

(12) United States Patent
Rowan et al.

(10) Patent No.: US 6,675,902 B2
(45) Date of Patent: Jan. 13, 2004

(54) PROGRESSIVE CAVITY WELLBORE PUMP AND METHOD OF USE IN ARTIFICIAL LIFT SYSTEMS

(75) Inventors: Ryan Patrick Rowan, Lloydminster (CA); Todd Alan Wilson, Lloydminster (CA); Roland Miles Moneta, Elk Point (CA)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/891,150

(22) Filed: Jun. 25, 2001

(65) Prior Publication Data

US 2002/0195254 A1 Dec. 26, 2002

(51) Int. Cl.[7] ..... E21B 43/00; F04B 47/00

(52) U.S. Cl. ..... 166/381; 166/105; 417/201; 417/319; 418/48

(58) Field of Search ..... 166/381, 105, 166/106, 68, 68.5; 418/48, 107; 417/201, 214, 319

(56) References Cited

U.S. PATENT DOCUMENTS

| | | | | |
|---|---|---|---|---|
| 3,347,169 A | | 10/1967 | Cronin, Jr. et al. | 103/117 |
| 4,592,427 A | * | 6/1986 | Morgan | 166/369 |
| 4,811,785 A | | 3/1989 | Weber | 166/242 |
| 5,209,294 A | * | 5/1993 | Weber | 166/105 |
| 5,220,829 A | * | 6/1993 | Manke et al. | 166/264 |
| 5,275,239 A | * | 1/1994 | Obrejanu | 166/210 |
| 5,725,053 A | * | 3/1998 | Weber | 166/105 |
| 5,979,550 A | * | 11/1999 | Tessier | 166/206 |
| 6,073,693 A | * | 6/2000 | Aldridge | 166/217 |
| 6,089,832 A | | 7/2000 | Patterson | 417/360 |
| 6,189,610 B1 | * | 2/2001 | LaClare et al. | 166/117.7 |

FOREIGN PATENT DOCUMENTS

| | | | |
|---|---|---|---|
| EP | 0 464 340 A2 | 1/1992 | E21B/23/00 |

OTHER PUBLICATIONS

International Search Report, International Application No. PCT/GB 02/02756, dated Oct. 8, 2002.
PCT Written Opinion, International Application No. PCT/GB02/02756, dated Apr. 16, 2003.

* cited by examiner

*Primary Examiner*—David Bagnell
*Assistant Examiner*—Daniel P. Stephenson
(74) *Attorney, Agent, or Firm*—Moser, Patterson & Sheridan, L.L.P.

(57) ABSTRACT

An artificial lift system used to produce fluids from boreholes such as oil and gas wells. The system uses a progressive cavity (PC) downhole pump system which can be inserted into the borehole, seated, operated, flushed and removed using conventional or coiled sucker rod tubing. The progressive cavity pump system includes a tubular body with a stator and a rotor within the stator. The rotor is connected to a rotatable string on one end and an arrowhead assembly on the other. A seating mandrel assembly maintains the rotor within the stator. The seating mandrel assembly has a component configured to engage with the arrowhead assembly so that the pump may be removed from a downhole location.

27 Claims, 4 Drawing Sheets

PROGRESSIVE CAVITY WELLBORE PUMP AND METHOD OF USE IN ARTIFICIAL LIFT SYSTEMS

BACKGROUND OF THE INVENTION

1. Field of the Invention

This invention is directed toward artificial lift systems used to produce fluids from boreholes such as oil and gas wells. More particularly, the invention is directed toward an improved downhole progressive cavity pump that is inserted and operated within a borehole, and subsequently removed from the borehole, using a coiled or conventional sucker rod, or other rotatable strings that may be used to transmit torque to the pump.

2. Background of the Related Art

Modern oil and gas wells are typically drilled with a rotary drill bit and a circulating drilling fluid or "mud" system. The mud system (a) serves as a means for removing drill bit cuttings from the well as the borehole is advanced, (b) lubricates and cools the rotating drill bit, and (c) provides pressure within the borehole to balance internal pressures of formations penetrated by the borehole. Rotary motion is imparted to the drill bit by rotation of a drill string to which the bit is attached. Alternately, the bit is rotated by a mud motor which is attached to the drill string just above the drill bit. The mud motor is powered by the circulating mud system. Subsequent to the drilling of a well, or alternately at intermediate periods during the drilling process, the borehole is cased typically with steel casing, and the annulus between the borehole and the outer surface of the casing is filled with cement. The casing preserves the integrity of the borehole by preventing collapse or cave-in. The cement annulus hydraulically isolates formation zones penetrated by the borehole that are at different internal formation pressures.

Numerous operations occur in the well borehole after casing is "set". All operations require the insertion of some type of instrumentation or hardware within the borehole. Examples of typical borehole operations include:

(a) setting packers and plugs to isolate producing zones;
(b) inserting tubing within the casing and extending the tubing to the prospective producing zone; and
(c) inserting, operating and removing pumping systems from the borehole.

Fluids can be produced from oil and gas wells by utilizing internal pressure within a producing zone to lift the fluid through the well borehole to the surface of the earth. If internal formation pressure is insufficient, artificial fluid lift means and methods must be used to transfer fluids from the producing zone and through the borehole to the surface of the earth.

The most common artificial lift technology utilized in the domestic oil industry is the sucker rod pumping system. A sucker rod pumping system consists of a pumping unit that converts a rotary motion of a drive motor to a reciprocating motion of an artificial lift pump. A pump unit is connected to a polish rod and a sucker rod "string" which, in turn, operationally connects to a rod pump in the borehole. The string can consist of a group of connected, essentially rigid, steel sucker rods sections (commonly referred to as "joints") in lengths of 25 or 30 feet (ft), and in diameters ranging from ⅝ inches (in.) to 1-¼ in. Joints are sequentially connected or disconnected as the string is inserted or removed from the borehole, respectively. Alternately, a continuous sucker rod (hereafter referred to as COROD) string can be used to operationally connect the pump unit at the surface of the earth to the rod pump positioned within the borehole. A delivery mechanism rig (hereafter CORIG) is used to convey the COROD string into and out of the borehole.

Prior art borehole pump assemblies of sucker rod operated artificial lift systems typically utilize a progressive cavity (hereafter PC) pump positioned within wellbore tubing. A typical prior art insertable PC pump system will be described, and includes a pump subsection consisting of a rotor operating within a stator. A tag bar/no-turn subsection is connected below the stator/rotor assembly. Typically, a flush tube extension is connected above the stator/rotor assembly, with a seating/no-go assembly and a cloverleaf pick-up positioned above the flush tube extension. The prior art insertable PC pump assembly requires a special joint of tubing containing a pin protruding into the interior of the tube. A pump seating nipple is also required above the special joint of tubing. It should be understood that the discussed prior art system is used as an example, and that variations of the discussed system using, as examples, different hold down systems and different torque stopping devices are in the prior art.

The prior art PC pump rotor and stator, flush extension tube, cloverleaf pick-up and seating/no-go components are all assembled prior to insertion into the borehole tubing thereby creating an insertable PC pump assembly.

Before the PC pump is positioned and operated down hole, the previously mentioned special joint of tubing with pin and attached seating nipple must be installed in the tubing string so that the pump will be positioned to lift from a particular producing zone of interest. If the pump assembly is subsequently positioned at a shallower or at a deeper zone of interest within the well, this can be accomplished by removing the tubing string, or by adding or subtracting joints of tubing. This repositions the special joint of tubing as required.

Once the special tubing and seating nipple are installed in the tubing string, the insertable PC pump assembly is run, from surface of the earth, downhole inside of the tubing by a COROD or a conventional sucker rod system. When reaching the special tubing joint, a forked torque slot at the lower end of the insertable PC pump assembly tag bar/no-turn subsection aligns with the pin protruding near the bottom in the special tubing joint. Once the torque fork aligns with and engages the pin, the insertable PC pump assembly is locked radially within the tubing and can not spin within the tubing when the pump is operated. After the torque fork and pin have aligned, the seating/no-go assembly located at the top of the PC pump then slides into and seals in the seating nipple until it is stopped by the no-go. The prior art insertable PC Pump is now completely installed down hole.

The prior art insertable PC pump is removed by lifting the sucker rod string until a coupling on the top of the rotor shoulders out on the clover leaf located on the top of the extension tube just below the seating/no-go assembly. The seating/no-go assembly is then extracted from the seating nipple, and the insertable PC pump assembly can be pulled, using COROD or conventional sucker rod string, to surface for servicing or repositioning. Once pulled, a new insertable PC pump of identical length and identical outside diameter can be installed as outline above.

The operating envelope of an insertable PC pump is dependent upon pump length, pump outside diameter and the rotational operating speed. In the prior art system, the pump length is essentially fixed by the distance between the seating nipple and the no turn pin in the special joint of tubing. Pump diameter is essentially fixed by the seating nipple size. Stated another way, these factors define the operating envelope of the pump. For a given operating speed, production volume can be gained by lengthening stator pitch and decreasing the total number of pitches inside the fixed operating envelope. Volume is gained at the expense of decreasing lift capacity. On the other hand, lift capacity can be gained within the fixed operating envelope by shortening stator pitch and increasing the total number of pitches. Production volume can only be gained, at a given lift capacity, by increasing operating speed. This, in turn, increase pump wear and decreases pump life. For a given operating speed and a given seating nipple sizes, the operating envelope of the prior art system can only be changed by pulling the entire tubing string and adjusting the operating envelope by changing the distance between the seating nipple and the special joint of tubing containing the locking pin. Alternately, the tubing can be pulled and the seating nipple can be changed thereby allowing the operating envelope to be changed by varying pump diameter. Either approach requires that the production tubing string be pulled at significant monetary and operating expense.

During operation, it is possible that the insertable PC pump assembly may need to be flushed to remove sand and other debris from the stator/rotor subsection. To perform this flushing operation, the rotor component is pulled upward from the stator by means of the sucker rod string. In order to avoid disengaging the entire pump assembly from the seating nipple, the rotor is moved upward only until it is located in the flush tube between the seating/no-go assembly and the stator/rotor subassembly. The pump may now be flushed, and then the rotor reinstalled without completely reseating the entire pump assembly. Since the prior art insertable PC pump assembly is picked up from the top of the rotor, the flush tube extension assembly is required. Furthermore, the length of the flush tube extension must be at least as long as the rotor, for reasons that will become apparent in a subsequent section of this disclosure. The entire assembly will then be at least twice as long as the stator. This presents a problem in optimizing stator length within the operation, and clearly illustrates a major deficiency in prior art insertable PC pump systems.

In summary, the prior art insertable PC pump system described above requires a special joint of tubing containing a welded, inwardly protruding pin for radial locking and a seating nipple. The seating nipple places some restrictions upon the inside diameter of the tubing in which the pump assembly can be operated. This directly constrains the outside diameter of the insertable pump assembly. The overall distance between the pin and the seating nipple constrains the length of the pump assembly. In order to change the length of the pump assembly to increase lift capacity (by adding stator pitches) or to change production volume (by lengthening stator pitches), (1) the entire tubing string must be removed and (2) the distance between the seating nipple and the locking pin must be adjusted accordingly before the tubing is reinserted into the well. Axial repositioning of the pump without changing length can be done by adding or subtracting tubing joints to reposition the seating nipple and the locking pin as a unit. The prior art PC pump assembly requires a flush tube assembly so that the rotor can be removed from the stator for flushing. This increases the length of the assembly, and also adds to the mechanical complexity and the manufacturing cost of the assembly.

As noted previously, other prior art insertable PC pump systems are commercially available. All systems, however, comprise the above discussed limitations of fixed seating nipple inside diameter, fixed length between seating nipple and a rotational locking device, pick up from the top of the rotor, and an extension tube.

SUMMARY OF THE INVENTION

The present invention is an improved insertable progressive cavity (PC) borehole pump assembly for use in any rotational operated artificial lift systems. The PC pump subsection consists of a rotor operating within a stator. The lower end of the rotor is terminated with a retaining structure that will hereafter be referred to as an "arrowhead". A torque restraining tool subsection is connected to the stator/rotor assembly. A seating/no-go pick up housing and floating ring subassembly is connected above the stator/rotor assembly. Alternately, the seating/no go can be located below the stator but the floating ring subassembly must always be above the stator. A pump seating nipple is used in the tubing string to receive and seat the pump assembly at the seating subassembly.

The PC pump subsection containing (a) the arrowhead attached to the rotor, (b) the torque restraining subsection, and (c) the seating/no-go pick up housing and floating ring assembly are assembled at the surface thereby creating the insertable PC pump unit. Before the insertable PC pump is installed downhole, the seating nipple is first installed in the tubing string. After seating nipple installation, the insertable PC pump assembly is then inserted in the borehole, inside of the tubing, preferably by means of COROD or conventional sucker rod system from surface of the earth. Other rotatable string means, such as tubing, can be used for insertion and operation. Furthermore, the system does not necessarily have to be operated inside production tubing, but can operate in other tubular strings such as casing. In one embodiment, all components of the pump assembly, including the torque restraining subassembly, pass through the seating nipple with the exception of the seating/no-go pick up housing and floating ring assembly. In other embodiments, some components can pass through or stay above the seating nipple, depending upon the location of the mandrel and the no-go. If the system is configured so that the seating nipple is at the bottom of the pump, the stator will not pass through the seating nipple but the torque restraining "no-turn" may or may not pass through. If the seating nipple is at the top of the assembly, the stator will pass through the seating nipple but the no-turn may or may not pass through the seating nipple. The no-turn is positioned at the top or the bottom thereby determining if it must pass through the seating nipple or not. The housing seats and seals in the seating nipple, and is stopped by the no-go. Pump intake and exhaust are isolated by the seal. At this point, the insertable PC pump assembly is completely installed.

The insertable PC pump assembly is removed from the wellbore by lifting the sucker rod string thereby pulling the rotor through the stator and through the floating ring, until the arrowhead on the bottom of the rotor reaches the floating ring. The arrowhead is sized so that it can not pass through the floating ring, but will freely move through the stator. When the rotor is lifted to a point where the arrowhead engages the floating ring, continued lifting of the sucker rod pulls the entire insertable PC pump assembly from the seating nipple. The pump can now be conveyed to surface by a COROD rig, by conventional sucker rod pulling means and procedures, or by other rotatable tubular pulling means. In an alternate embodiment, the tubular can be non-rotating.

In this embodiment, the non-rotating tubular is terminated downhole with a rotating drive means which, in turn, provides the needed rotational motion to operate the pump system.

As with prior art PC pumps, it is possible that the insertable PC pump assembly set forth in this disclosure may need to be flushed of sand and other debris. This is accomplished by pulling, by means of the sucker rod string, the rotor out of the stator and through the pick up housing until the arrowhead is positioned between the top of the stator rubber and the floating ring. This positions the stator and rotor so that the pump can be effectively flushed. After flushing, the procedure is essentially reversed so that the rotor is again positioned within the stator for pump operation.

Prior art insertable PC systems require a special tubing joint with an internally protruding welded pin to insure that the assembly does not rotate. The pin to seating nipple distance limits the length of the pump assembly. The improved insertable PC pump assembly requires no special tubing joint with an internally protruding, welded pin to insure that the assembly does not rotate. The torque restraining subassembly, which is an integral part of the insertable pump unit, is used to releasably grip the interior of the tubing thereby preventing rotation of the stator assembly during operation. The improved insertable PC pump assembly can be removed, the length can be varied thereby allowing changes in volumetric displacement and/or lift capacity, and the assembly can be reinstalled in the same seating nipple as long as the outside diameter of the insertable PC pump assembly is compatible with the dimensions of the seating nipple. This is possible because the torque restraining assembly can releasably grip the interior of tubing at any axial position. No restraining pin is required. The pump can be removed and adjustments in volumetric displacement and/or lift capacity can be made by varying pump length and without having to remove tubing and altering the spacing between a seating nipple and a no turn pin as in prior art systems.

Since the previously discussed prior art insertable PC pump assembly picks up from the top of the rotor, the flush extension tube is required. Furthermore, the flush tube must be at least as long as the rotor. The stator/rotor subsection must, therefore, be at least twice as long as the stator. The improved PC pump assembly picks up from the bottom of the rotor, therefore no flush tube is required. When configured for flushing, the rotor extends substantially into the production tubing thereby allowing the length of the improved pump assembly to be reduced to almost half the length of the prior art system. The improved insertable PC pump can therefore be fabricated for larger production volumes and higher lifts within a tightly constrained operating envelope defined by outside diameter and length.

The improved insertable PC pump assembly contains fewer special parts and therefore is less costly to manufacture, to operate, and to maintain.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

The present invention is an improved insertable progressive cavity (PC) borehole pump assembly for use in sucker rod operated artificial lift systems. The pump assembly will operate equally effectively using any type of preferably rotatable string for imparting rotation to the pump. Alternately, a non-rotating string can be used with the downhole end of the string being terminated by a drive means that, in turn, imparts rotation to the pump. The assembly will operate in any type of tubular string, although the most common operation is within production tubing.

To fully illustrate the mechanical and operational improvements of the disclosed insertable PC pump system, a typical prior art PC pump apparatus and operation will be described in detail.

Prior Art System

Figure 1:
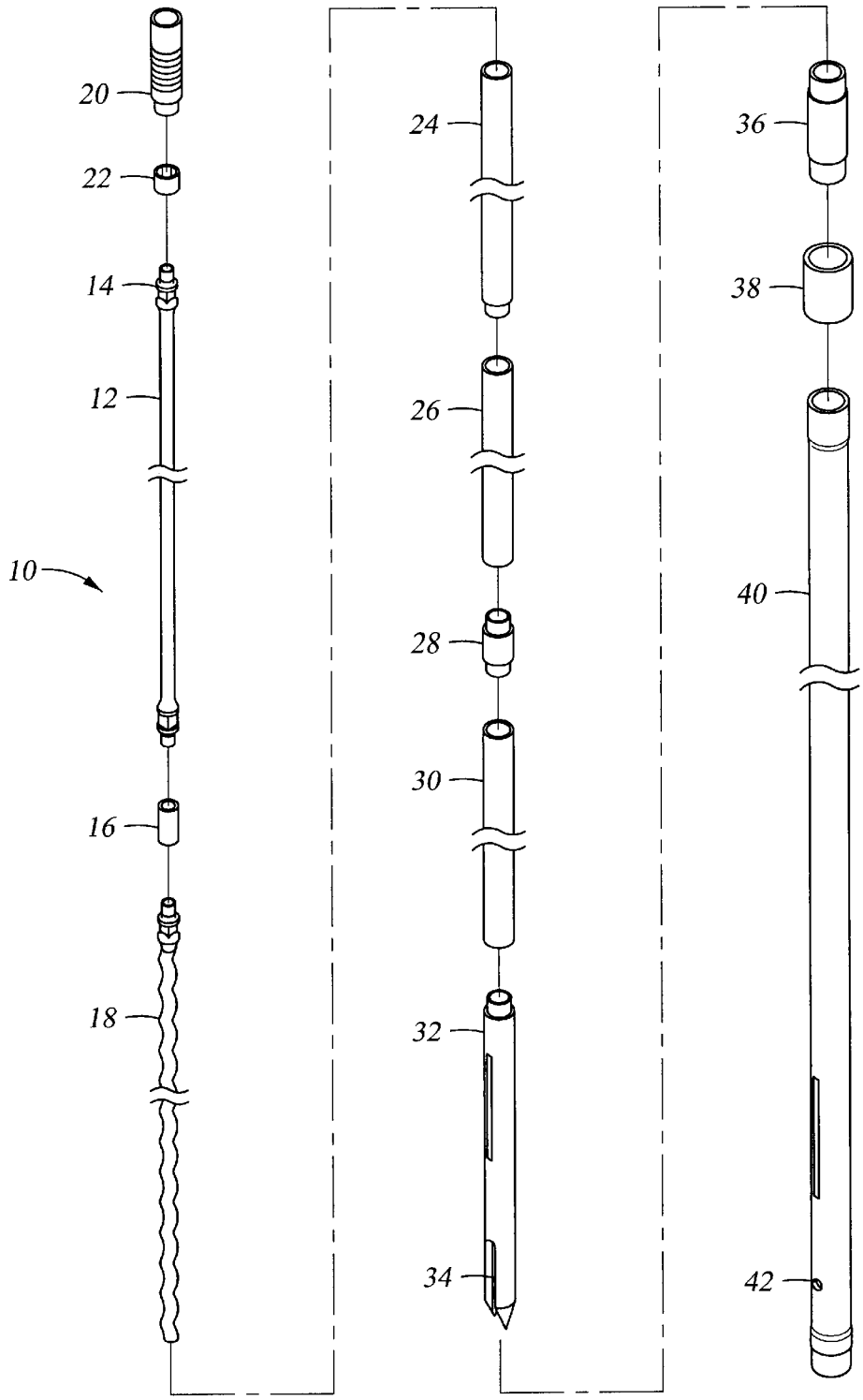
Fig. 1 (PRIOR ART)
FIG. 1 illustrates a prior art insertable PC pump system.

Attention is directed to FIG. 1, which illustrates a prior art insertable PC pump assembly denoted as a whole by the numeral 10. It should be understood that the prior art contains other PC pump systems, but the system illustrated in FIG. 1 is typical in that it exhibits limitation present in all other known prior art systems.

Still referring to FIG. 1, a seating mandrel 20 containing a pick-up insert 22 is positioned at the top of the assembly 10. A pony rod 12 is connected to the top of a rotor 18 by means of a pick-up coupling 16. The top of the pony rod is connected to a COROD string (not shown) or to a conventional sucker rod string (not shown) by means of a connector 14. The pony rod 12 and rotor 18 are inserted within a tubular section comprising a pick-up assembly 24 with a seating/no-go assembly 20 and a cloverleaf pick-up 22, a flush extension tube 26, and a stator 30 which is connected to the flush extension tube 26 by means of a barrel connector 28. As shown, 24 illustrates the top of the extension tube that keeps the cloverleaf in place between the seating mandrel and the tube. The elements 20, 22 and 24 as a group could alternately be defined as the pickup assembly. A tag bar/no-turn subsection 32 terminating with a fork 34 (mechanical hold down) is connected below the stator/rotor assembly.

Still referring to FIG. 1, the prior art pump assembly 10 requires a special joint or "locking" tubing 40 containing a pin 42 protruding into the interior of the tubing. A pump seating nipple 36 is connected to the top of the locking tubing joint 40 by means of a collar 38. The prior art insertable PC pump subassembly, flush extension tube, cloverleaf pick-up and seating/no-go components are all assembled prior to insertion into the borehole tubing thereby creating an insertable PC pump assembly.

The pump assembly 10 is operated within the tubing joint 40 as will be described in the following paragraphs. The locking joint 40 of tubing with the pin 42 and the seating nipple 36 must be installed in the tubing string so that the pump assembly 10, when installed downhole, will be positioned to lift from a particular producing zone of interest.

Figure 2A:
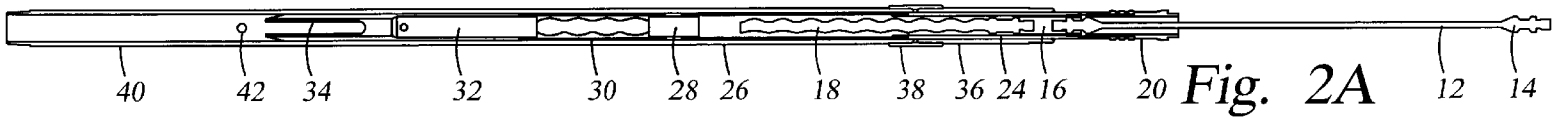
Fig. 2A (PRIOR ART)
FIG. 2*a* illustrates the prior art PC pump system being inserted into a borehole.

Once the special tubing and seating nipple are installed down hole in the tubing string, the insertable PC pump assembly is now run down hole inside of the tubing using a COROD or conventional sucker rod system. This step is illustrated in FIG. 2*a*.

Figure 2B:
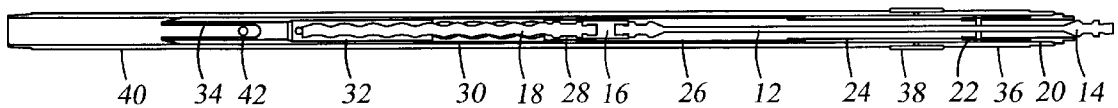
Fig. 2B (PRIOR ART)
FIG. 2*b* illustrates the prior art PC pump system being seated within the borehole.

When reaching the special locking tube joint 40, the forked torque slot 34 at the lower end of the assembly tag bar/no-turn subsection 32 aligns with the pin 42 as shown in FIG. 2*b*. Once the torque fork slot 34 aligns with and engages the pin 42, the PC pump assembly 10 is locked radially within the tubing 40 and can not spin within the tubing when the pump is operated. After the torque fork 34 and pin 42 have aligned and engaged, the seating/no-go assembly 20 located at the top of the PC pump will then slide into and seal in the seating nipple 36 until it is stopped by the no-go. The prior art insertable PC Pump 10 is now completely installed down hole.

Figure 2C:
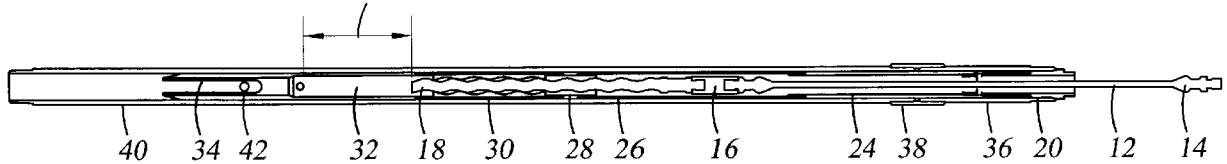
Fig. 2C (PRIOR ART)
FIG. 2*c* illustrates the prior art PC pump system being operated within the borehole.

FIG. 2*c* illustrates the prior art pump system 10 in operation, where the rotor 18 is moved up and down within the stator 30 by the action of the pony rod 12 and connected sucker rod string (not shown). After compensating for sucker rod stretch, the sucker rod string is slowly lifted a distance "A", designated as 52, off of the tag bar/no-turn subassembly 42. This positions the rotor 18 in a proper operating position with respect to the stator 30.

Figure 2D:
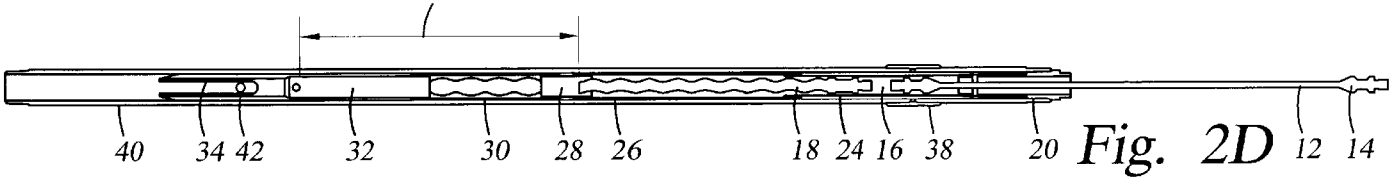
Fig. 2D (PRIOR ART)
FIG. 2*d* illustrates the prior art PC pump system being flushed.

FIG. 2*d* shows the system configured for flushing. The rotor 18 is lifted out of the stator 30 as indicated by the distance "B" at 54. The rotor and stator elements can then be flushed of debris using methods known in the art.

Figure 2E:
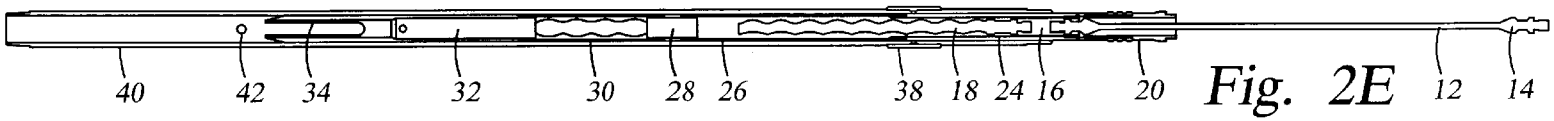
Fig. 2E (PRIOR ART)
FIG. 2*e* illustrates the prior art PC pump system being removed from the borehole.

FIG. 2*e* illustrates the pump assembly being removed from the locking tubing 40 and seating nipple 36. The sucker rod string is lifted until a coupling 16 on the top of rotor 18 shoulders out on the clover leaf pick-up insert 22 located just below the seating/no-go assembly 20. The seating/no-go assembly 20 is then extracted from the seating nipple 36 by further upward movement of the sucker rod string, and the PC pump assembly 10 is conveyed to the surface as the sucker rod string is withdrawn from the borehole.

Improved PC Pump System

Figure 3:
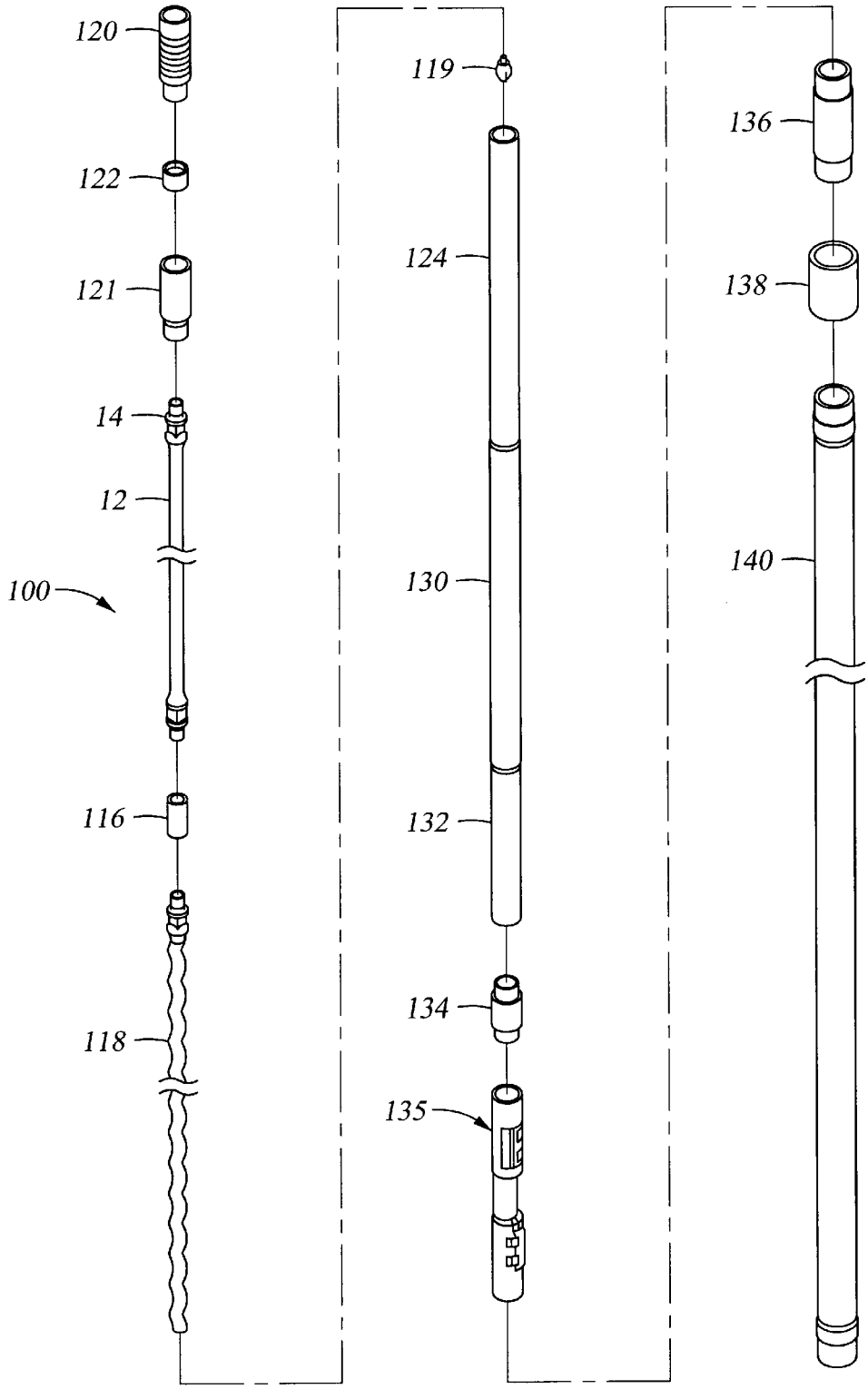
FIG. 3 illustrates an improved insertable PC pump system.

Attention is directed to FIG. 3, which illustrates the improved insertable PC pump assembly 100 set forth in this disclosure. A rotor 118 is terminated at a lower end by an "arrowhead" structure 119, and connected at an upper end to a pony rod 12 by means of a slim hole coupling 116. Alternately, the rod can be an integral part of the rotor 118. The top of the pony rod is connected to a COROD string (not shown) or a conventional sucker rod string (not shown) by means of a connector 14. Other rotatable means can be used to operate the system, such as tubing. The pony rod 12 and rotor 118 are inserted within a tubular section closed at the top with a seating mandrel assembly, comprising a mandrel/no-go top housing 120, a floating ring 122, and a bottom housing 121. Moving down the assembly 100, the seating mandrel assembly is connected to an upper extension tube 124, a stator 130 and a lower extension tube 132 containing a tag bar 127. Functions of the upper and lower extension tubes will become apparent in subsequent sections of this disclosure, and the tubes are considerably shorter in length than the flush extension tube 26 (see FIG. 1) of the previously described prior art PC pump system. The tubular section is terminated at the lower end by a torque restraining assembly 135. The assembly 135 is illustrated specifically as a dual acting no-turn assembly, which is connected to the lower extension tube 132 by means of a swage 134. Other types of operationally removable torque restraining assemblies such as packers can be used. It is also emphasized that the torque restraining assembly 135 can be positioned elsewhere in the pump assembly, such as above the stator assembly.

Still referring to FIG. 3, the PC pump assembly 100 is inserted into conventional wellbore tubing 140 through a seating nipple 136 attached to the tubing by means of a standard collar 138. The seating mandrel and seating nipple cooperate to form a seal to isolate the PC pump intake from the pump discharge. No special tubing section is required to install and operate the improved insertable PC pump assembly 100. The elements and assemblies of the pump 100 are assembled at the surface prior to insertion into the borehole tubing 140 thereby forming an insertable PC pump assembly.

FIGS. 4*a*–4*e* illustrate all phases of the operation of the improved insertable PC pump system 100.

Figure 4A:
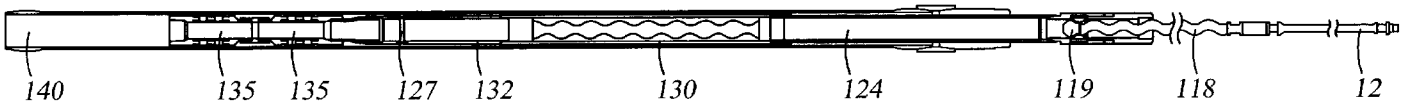
FIG. 4*a* illustrates the improved PC pump system being inserted into a borehole.

FIG. 4*a* illustrates the insertion of the pump assembly 100 within a well borehole. The seating nipple 136 is first positioned in the tubing string at the desired depth within the borehole. The pump assembly 100 is attached at the surface to a sucker rod string (not shown) by means of the connector 14. As an example, for 4-½ inch (in.) tubing, a 4-½ inch seating nipple would be positioned in the tubing string so that the intake of the pump is at the desired depth. With the seating nipple 136 properly positioned down hole, the pump assembly 100 is lowered inside the tubing string 140 using a conventional or a COROD string (not shown). It is good practice to insert a rod shear (not shown) approximately one joint of sucker rod above the pump 100, or at an equivalent distance in a COROD string. This permits easier remedial action if the pump system abnormally malfunctions.

Figure 4B:
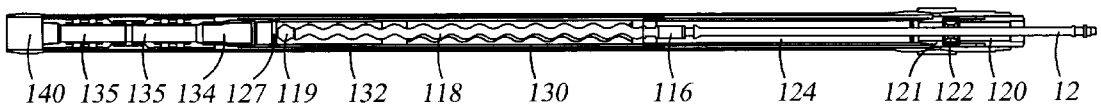
FIG. 4*b* illustrates the improved PC pump system being seated within the borehole.

Pump seating is illustrated in FIG. 4*b*. The pump assembly 100 attached to the sucker rod string is lowered into the borehole until the weight of the assembly, measured at the surface, decreases to near zero. When this occurs, the seating mandrel assembly 120 should be seated within the seating nipple 136. Allowances must me made depending upon whether the pump is fully extended or on a tag bar 127. It is desirable to fill the tubing string with fluid to ensure that the pump 100 is seated properly. This will also help to prevent unseating of the pump when trying to properly position the rotor 118 for operation. If the tubing string holds fluid under pressure, a proper seal has been made with the seating assembly and the nipple 136. Stated another way, a verification of proper seating can be obtained by monitoring fluid level within the tubing. If the tubing string does not fill or the level drops, a proper seal has not been made between the seating mandrel 120 and the seating nipple 136. This can usually be remedied by tapping down lightly on the rotor 118 attached to the sucker rod string to contact the tag bar 127 and thereby ensure that the mandrel 120 is seated properly inside the nipple 136. The torque restraining assembly tool 135 is then engaged thereby gripping the inside wall of the tubing 140. This prevents the housing components of the pump 100 from rotating with the rotor 118 during pump operation. The torque restraining assembly 135, is shown as a no-turn assembly in FIG. 3. The assembly may be of any design as long as it prevents rotation of the stator section 130 during operation of the pump.

Figure 4C:
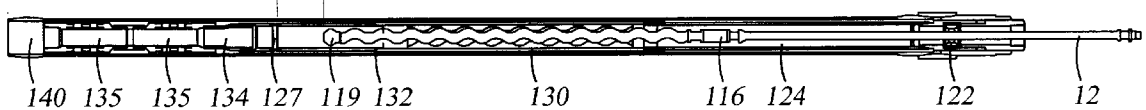
FIG. 4*c* illustrates the improved PC pump system being operated within the borehole.

FIG. 4*c* illustrates the PC pump system 100 in operation, where the rotor 118 is moved up and down within the stator 130 by the action of the pony rod 12 and connected sucker rod string (not shown). After compensating for sucker rod stretch, the sucker rod string is slowly lifted a distance 150, off of the tag bar 127. This positions the rotor 118 in a proper operating position with respect to the stator 130. The distance 150 is typically about 12 in.

Figure 4D:
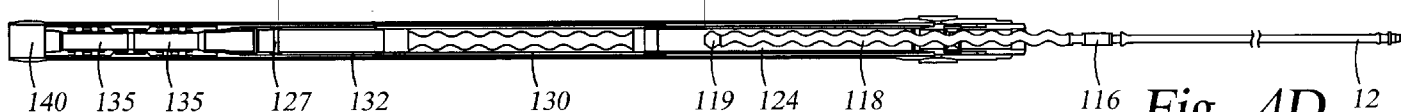
FIG. 4*d* illustrates the improved PC pump system being flushed.

FIG. 4*d* shows the system configured for flushing. The rotor 118 is lifted out of the stator 130 as indicated by the distance 160. This distance is typically the length of the rotor 118. Lifting the rotor 118 by more that the specified distance 160 may unseat the pump assembly 100 by means of the arrowhead 119 contacting the floating ring 122. The rotor and stator elements are now positioned to be flushed of debris using methods known in the art.

Figure 4E:
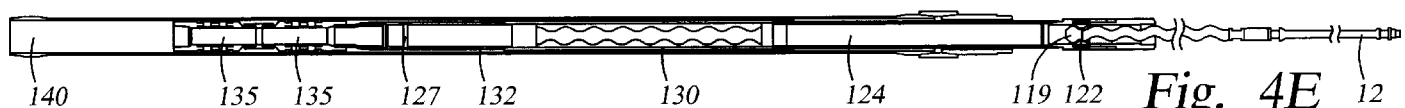
FIG. 4*e* illustrates the improved PC pump system being removed from the borehole.

FIG. 4*e* illustrates the removal of the PC pump assembly from the tubing 140. The sucker rod string is lifted by a distance greater than 160, with 160 being the overall length of the rotor 118. Then when the arrowhead structure 119 engages with the floating ring 122, there will be a sharp increase in sucker rod string weight as detected at the surface. This indicates that the pump assembly 100 is being unseated by the upward force exerted at contact point of the arrowhead 119 and the engagement ring 122. Once unseated, the pump 100 is raised to surface by a CORIG system or a convention sucker rod pulling unit.

SUMMARY

A typical prior art insertable PC pump system and an improved insertable PC pump system have been described and illustrated in detail. As discussed previously, the prior art system is typical in that it exhibits limitation present in all other known prior art systems. Operational, economic and reliability advantages of the improved PC pump system set forth in this disclosure are summarized below.

The prior art insertable PC pump system 10 (see FIG. 1) systems require a special tubing joint with an internally protruding, welded pin to insure that the housing assembly does not rotate. This introduces adverse economic, operational and reliability factors. Furthermore, the special tubing limits the length of the pump assembly, since the protruding pin defines assembly length. The seating nipple inside diameter limits the maximum outside diameter of the insertable PC pump assembly. The improved insertable PC pump assembly 100 (see FIG. 3) requires no special tubing joint to insure that the assembly does not rotate. The dual acting torque restraining device 135 (shown as a dual acting no-turn tool for purposes of illustration), which is an integral part of the insertable pump unit 100, is used prevent rotational movement of the pump housing during operation. The torque restraining assembly 135 can be operationally set and released at any axial position within the tubing. The improved pump assembly 100 can be removed, length can be varied, and the assembly can be reinstalled in the same seating nipple as long as the outside diameter of the seating assembly is compatible with the dimensions of the seating nipple. This can be done without having to remove the tubing string to alter spacing between a seating nipple and a no-turn pin, as is the case in prior art insertable PC pump systems.

Since the prior art PC pump assembly 10 is picked up from the top of the rotor, the flush extension tube 26 is required. Furthermore, the flush tube must be at least as long as the rotor. The stator/rotor subsection must, therefore, be at least twice as long as the stator. The improved PC pump assembly 100 picks up from the bottom of the rotor when the arrowhead structure 119 contacts the floating ring 122 and then the housing 121. No flush tube is required in the improved PC pump 100. When configured for flushing, the rotor extends 118 substantially into the tubing 140 thereby allowing the length of the improved pump assembly to be reduced to almost half the length of the prior art system.

The improved insertable PC pump assembly 100 contains fewer special parts and therefore should be less costly to manufacture, to operate and to maintain.

It should be understood that the basic concepts set forth in this disclosure are applicable to other apparatus and methods. As an example, the lifting technique can be adapted to any type of pump operated by a sucker rod string. As another example, the torque restraining assembly can be used to rotationally stabilize other types of downhole pumping systems. This pump system can be driven by means other than sucker rod, such as tubing or any mechanism that can impart rotation to the pump assembly. Alternately, the pump system can be operated by a non-rotating tubular string terminated downhole by a drive means, wherein the drive means can be retrieved by a wireline or other means.

While the foregoing is directed to embodiments of the present invention, other and further embodiments of the invention may be devised without departing from the basic scope thereof, and the scope thereof is determined by the claims that follow.

What is claimed is:

1. A PC pump system insertable into a borehole, comprising:

(a) a tubular body comprising stator;

(b) a rotor positioned within the stator and operationally connected to a rotatable string;

(c) a wedge-shaped structure connected to the rotor; and (d) a seating assembly to position the tubular body within the tubular string.

2. The PC pump system of claim 1 wherein elements of said system are assembled prior to positioning within said tubular string.

3. The PC pump system of claim 1, wherein the tubular string comprises production tubing within the borehole.

4. The PC pump system of claim 1, wherein said rotatable string comprises sucker rod.

5. The PC pump system of claim 1, further comprising a lifting assembly connected to the tubular body for lifting the pump system from the borehole.

6. The PC pump system of claim 5, wherein the wedge-shaped structure will not pass through the lifting assembly.

7. The PC pump system of claim 1 further comprising a sealing means for isolating intake of said PC pump from discharge of said PC pump.

8. The PC pump system of claim 1, wherein the wedge-shaped structure is connected to a lower end of the rotor.

9. The PC pump system of claim 1, further comprising a torque restraining assembly connected to the tubular body, wherein the torque restraining assembly radially locks the tubular body within the tubular string.

10. The PC pump system of claim 9, wherein the torque restraining assembly is removably operable at any axial position within the tubular string.

11. The PC pump system of claim 9, wherein the torque restraining assembly locks the tubular body within the tubular string by gripping inside of the tubular string.

12. The PC pump system of claim 9, wherein the torque restraining assembly is located above the stator.

13. The PC pump system of claim 1, wherein the seating assembly further comprises a floating ring and the wedge-shaped structure is dimensioned to engage with the floating ring.

14. The PC pump system of claim 1, wherein the wedge-shaped assembly will pass through the stator.

15. The PC pump system of claim 1, wherein the rotor will pass through the seating assembly.

16. A method of flushing an insertable PC pump, comprising the steps of:

(a) providing a PC pump system comprising
  (i) a tubular body comprising a stator and a seating mandrel assembly connected to an upper end of said tubular body,
  (ii) a rotor positioned within said tubular body and operationally connected to a rotatable sting at an upper end and terminated by an arrowhead structure at a lower end, and
  (iii) a torque restraining assembly connected to said tubular body, wherein said torque restraining assembly radially locks said tubular body within said tubular string;

(b) lifting said rotor out of said stator to a position within said tubular body where said arrowhead structure is positioned below but not abutting said seating mandrel assembly; and (c) flowing fluid through said stator and around said rotor to remove debris from said pump system.

17. The method of claim 16 comprising the additional steps of:

(a) providing a tag bar in said tubular body below said stator; and (b) lifting said rotor a distance so that the distance between said arrowhead structure and said tag bar is equal to the length of said rotor.

18. A method of removing a seating insertable PC pump, comprising the steps of:

(a) providing a PC pump system comprising
  (i) a tubular body comprising a stator and a seating mandrel assembly connected to an upper end of said tubular body and containing a floating ring,
  (ii) a rotor positioned within said tubular body and operationally connected at an upper end to a rotatable string and terminated at a lower end by an arrowhead structure, and
  (iii) a torque restraining assembly connected to said tubular body, wherein said torque restraining assembly radially locks said tubular body within said tubular string;

(b) disengaging said torque restraining assembly from said tubular string;

(c) by means of said rotatable string, moving said rotor upward within said tubular body until said arrowhead structure engages said floating ring; and (d) removing said rotatable string from said tubing string thereby conveying said insertable PC pump to the surface of the earth.

19. A method of flushing an insertable PC pump, comprising the steps of:

(a) providing a PC pump system comprising:
  (i) a tubular body comprising a stator; and
  (ii) a rotor positioned within the tubular body terminated by an arrowhead structure;

(b) lifting the rotor out of the stator to a position whereby the rotor extends substantially into a production tubing; and (c) flowing fluid through the stator and around the rotor to remove debris from the PC pump system.

20. The method of claim 19, wherein the arrowhead structure terminates a lower end of the rotor.

21. The method of claim 19, further comprising:

(d) providing a tag bar in the tubular body below the stator; and (e) lifting the rotor a distance so that the distance between the arrowhead structure and the tag bar is equal to the length of the rotor.

22. A method of removing an insertable PC pump, comprising:

(a) providing a PC pump system within a borehole, wherein the PC pump system comprises:
  (i) a tubular body comprising a stator and a seating assembly containing a floating ring, and
  (ii) a rotor positioned within the tubular body connected to a wedge-shaped structure;

(b) moving the rotor upward within the tubular body until the wedge-shaped structure engages the floating ring; and (c) removing the PC pump from the borehole.

23. The method of claim 22, wherein the seating assembly is connected to an upper end of the tubular body.

24. The method of claim 22, wherein the wedge-shaped structure is connected to a lower end of the tubular body.

25. A progressive cavity pump system comprising:

(a) a tubular member comprising a stator;

(b) an upper extension tube above the tubular member;

(c) a lower extension tube below the tubular member;

(d) a rotor positioned within the stator and connected to a rotatable string;

(e) a wedge-shaped structure connected to a lower end of the rotor; and (f) a seating mandrel assembly that closes a top of the upper extension tube after the rotor has been inserted into the tubular member.

26. The progressive cavity pump of claim 25, wherein a torque restraining assembly is connected to the tubular member and prevents rotation of the tubular member within a wellbore tubing.

27. The progressive cavity pump of claim 25, wherein the torque restraining assembly is located above the stator.

* * * * *